US006752058B2

(12) United States Patent
Oh

(10) Patent No.: US 6,752,058 B2
(45) Date of Patent: Jun. 22, 2004

(54) PUNCHING DEVICE FOR EDGE DECORATION

(75) Inventor: Wan-Young Oh, Seoul (KR)

(73) Assignee: DN Craft Corporation, Seoul (KR)

( * ) Notice: Subject to any disclaimer, the term of this patent is extended or adjusted under 35 U.S.C. 154(b) by 50 days.

(21) Appl. No.: 10/151,906

(22) Filed: May 22, 2002

(65) Prior Publication Data

US 2003/0205122 A1 Nov. 6, 2003

(30) Foreign Application Priority Data

May 3, 2002 (KR) ..... 2002-24514

(51) Int. Cl.[7] ..... B26D 7/01

(52) U.S. Cl. ..... 83/620; 83/439; 83/36; 83/467.1; 83/588; 83/633; 83/687; 83/691; 30/358

(58) Field of Search ..... 83/687, 686, 910, 83/685, 684, 690, 691, 613, 633, 637, 588, 439, 440, 442, 569, 620, 466.1, 444, 619, 36, 465, 467.1, 917, 249; 434/81, 82; 33/423, 627, 628, 630; D19/37, 41, 72, 86, 100; D15/128; D8/98; 30/358, 363, 364, 229

(56) References Cited

U.S. PATENT DOCUMENTS 281,113 A * 7/1883 Morris ..... 83/529
1,684,934 A * 9/1928 Woodworth ..... 83/567
1,718,476 A * 6/1929 Messmer, Jr. ..... 83/690
2,108,178 A * 2/1938 Rosenberg ..... 83/468.93
2,163,868 A * 6/1939 Christie ..... 83/468.93
4,509,397 A * 4/1985 Mori et al. ..... 83/453
4,539,880 A * 9/1985 Barber et al. ..... 83/468.8
5,967,786 A * 10/1999 Wang ..... 434/82
6,089,137 A * 7/2000 Lee ..... 83/621
6,145,425 A * 11/2000 Bonnar et al. ..... 83/522.15
6,209,434 B1 * 4/2001 Kim et al. ..... 83/549
RE38,219 E * 8/2003 Lee et al. ..... 83/588

* cited by examiner

*Primary Examiner*—Boyer D. Ashley
(74) *Attorney, Agent, or Firm*—Jones Day

(57) ABSTRACT

The punching device for edge decoration enables repeated punching of a pattern in a target, such as paper along edges of the target. The punching device includes a jig in which a predetermined pattern is perforated, a punching member having a section corresponding to the perforated pattern and being slidable through the perforated pattern, and a base combined with the jig and having an angle (2) in range of 60°<2<180° to the perforated pattern. The base having a standard marking with a pattern corresponding to all or part of the perforated pattern.

8 Claims, 17 Drawing Sheets

PUNCHING DEVICE FOR EDGE DECORATION

BACKGROUND OF THE INVENTION

1. Field of the Invention

The present invention relates to a punching device, and more particularly to a punching device for edge decoration, which enables to repeatedly punch a pattern in a target such as paper along edges of the target.

2. Description of the Related Art

Generally, a punching device, which is also called 'punch' in common, includes a jig in which a specific pattern is perforated and a sharp cutting means sliding through the perforated pattern. This punching device performs punching a desired area in a target according to the perforated pattern.

There have been developed various kinds of punching devices. However, these punching devices are not appropriate to perforate a target along its edge accurately because they are mainly purposed to pick out a certain area of the target.

In other words, when punching same pattern successively along an edge of card, letter paper, photograph or other various boards for decoration, a user punches the pattern by only eye measurement, thus resulting in irregular arrangement of punched patterns in the target.

SUMMARY OF THE INVENTION

The present invention is designed to overcome such disadvantages of the prior it, and an object of the invention is to provide a punching device, which enables to accurately punch same pattern successively along an edge of a target.

In order to accomplish the above object, the present invention provides a punching device for edge decoration, which includes a jig in which a predetermined pattern is perforated, a punching member having a section corresponding to the perforated pattern and being slidable through the perforated pattern, and a base combined with the jig and having an angle ($\theta$) in range of $60° \leqq \theta \leqq 180°$ to the perforated pattern, the base also having a standard marking with a pattern corresponding to all or part of the perforated pattern.

Preferably, the angle ($\theta$) is determined to be an interior angle of a closed polygon having a circumference corresponding to integer times of a length of the perforated pattern.

The jig may includes an upper plate having a guide perforation to guide sliding movement of the punching member, and a lower plate installed to the upper plate with a predetermined gap for insertion of a target for punching, in which the pattern is perforated into the lower plate at a position corresponding to the guide perforation.

The base may further have a guide protrusion to guide an outer circumference of a circular target for punching.

In another aspect of the present invention, there is provided a punching device for punching edge of a rectangular target into a shape of closed polygon, which includes a jig in which a predetermined pattern is perforated, a punching member having a section corresponding to the perforated pattern and being slidable through the perforated pattern, and a base combined with the jig and having a horizontal guide at a rear position of the pattern to fit a side of the rectangular target thereto and an inclined guide having an angle of 45° with the horizontal guide so that the rectangular target is fit thereto with being turned 45°.

The punching device of the present invention may further include a guide member positioned at the rear of the perforated pattern, in which the guide member has two sides at a right angle to restrict insertion of the target to a predetermined level.

Preferably, an additional standard marking is formed on the base at one or both sides of the perforated pattern in parallel to the pattern, and the additional standard marking has a pattern corresponding to all or part of the perforated pattern.

BRIEF DESCRIPTION OF THE DRAWINGS

These and other features, aspects, and advantages of the present invention will become better understood with regard to the following description, appended claims, and accompanying drawings, in which like components are referred to by like reference numerals. In the drawings:

DETAILED DESCRIPTION OF THE PREFERRED EMBODIMENT

Hereinafter, preferred embodiments of the present invention will be described in detail with reference to the accompanying drawings.

Figure 1:
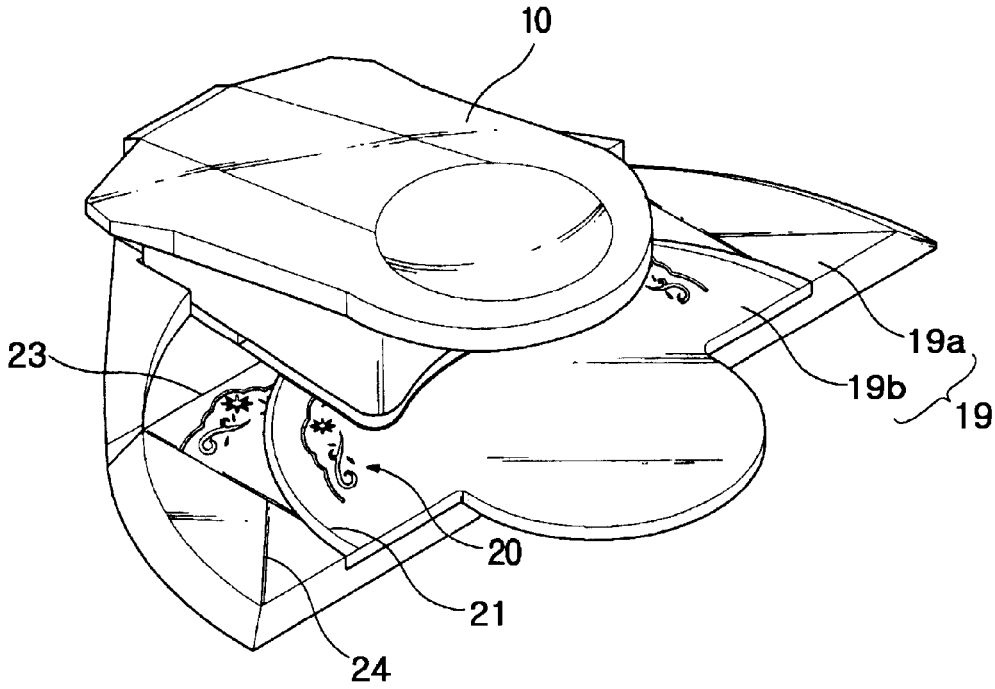
FIG. 1 is a perspective view showing a punching device according to a preferred embodiment of the present invention.
Figure 2:
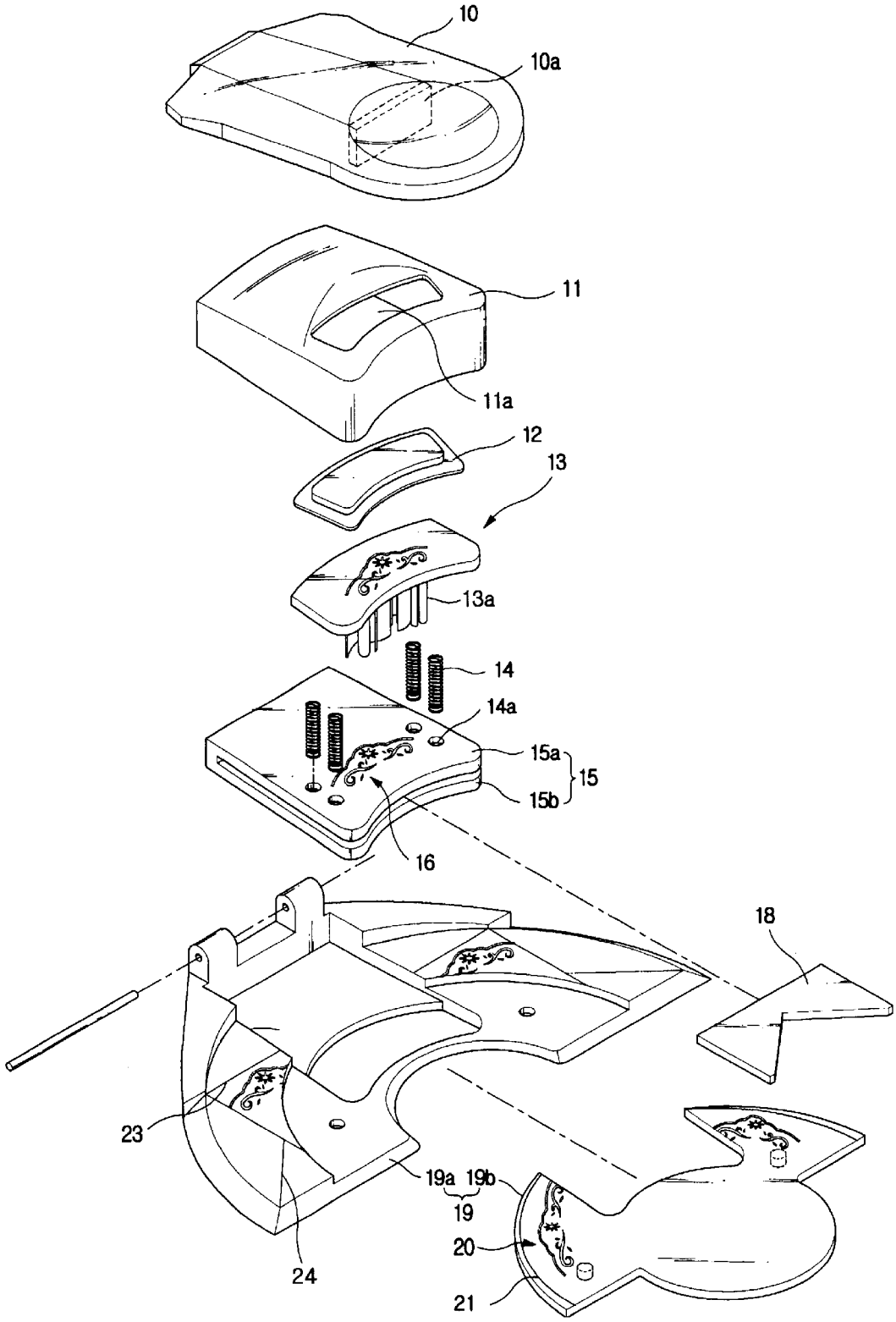
FIG. 2 is an exploded view of FIG. 1.

FIG. 1 is a perspective view showing a punching device according to a preferred embodiment of the present invention and FIG. 2 is an exploded view showing the punching device in detail. Referring to FIGS. 1 and 2, the punching device of the present invention broadly includes a pressing lever 10, a punching member 13, a jig 15 and a base 19.

The pressing lever 10 is pivotally connected to the base 19 so that the lever 10 presses the punching member 13 downward when pushed down by the hand of a user.

Figure 3:
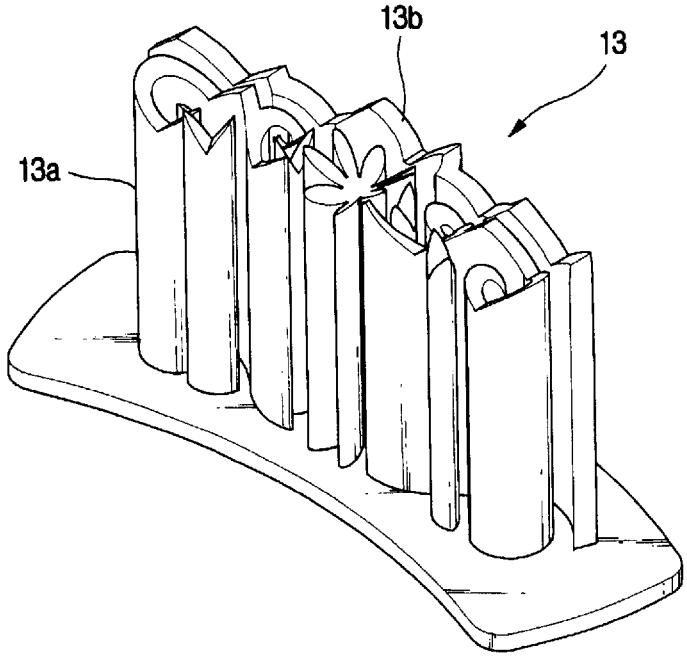
FIG. 3 is a perspective showing a punching member shown in FIG. 2.

The punching member 13 plays a role of punching a pattern in a target. For that purpose, a punch pin 13*a* having a corresponding pattern is formed at a lower portion of the punching member 13. At a lower edge of the punch pin 13*a*, formed is a cutting blade (not shown) to easily and clearly punch the pattern in the target. Preferably, the punching member 13 has a rim cutting pin 13*b*, as shown in FIG. 3, in order to cut off a necessary margin out of the pattern when punching.

The jig 15 supports a supplied target during punching. This jig 15 preferably includes upper and lower plates 15*a*, 15*b*, facing each other with a space into which a target to be punched can be inserted.

In the lower plate 15*b*, a pattern corresponding to the punch pin 13*a* is perforated. In the upper plate 15*a*, a guide hole 16 is formed to guide vertical movement of the punch pin 13*a*. Alternatively, it is also possible to configure the jig 15 integrally, not separating upper and lower plates 15*a*, 15*b*. In this configuration, the jig may include a plate (not shown) in which a pattern is perforated and a guide (not shown) for pressing and guiding a target supplied to an upper or lower surface of the plate.

An elastic member 14 is interposed between the punching member 13 and the jig 15 for elastically biasing the punching member 13 against the jig 15. Thus, after descending to punch a pattern in a target supplied to the jig 15, the punching member 13 returns its initial position owing to elasticity of the elastic member 14.

For that reason, a spring is adopted for the elastic member 14 in which one end is combined to a side of the upper plate 15*a* through a support 14*a* and the other end is combined to the punching member 13 to provide elastic force. As for the elastic member 14, leaf spring or other means can be adopted.

Though shown in the figure that the support 14*a* has a groove shape so that a lower end of the elastic member 14 seats thereon, the support 14*a* may have another configuration such as a protrusion so that the support 14*a* is inserted to a lower end of the elastic member 14.

Preferably, the punching member 13 is stably combined to the jig 15 in a housing 11. At an upper surface of the housing 11, a hole 11*a* is formed so that the press pin 10*a* at the pressing lever 10 may press an upper surface of the punching member 13 through the hole 11*a*.

More preferably, a cap member 12 may be further provided between the pressing lever 10 and the punching member 13 so as to prevent them from being directly contacted, for the purpose of smooth operation. This cap member 12 contacts with a broad area of the upper surface of the punching member 13, thus disperses pressure evenly to overall upper surface of the punching member 13 though a tip of the pressing pin 10*a* has a small area contacted with the cap member 12.

The base 19 configures a foundation of the device. This base 19 supports the above-described parts and acts as a basis on which a target is supplied for formation of pattern. The pressing lever 10 is hinged to the base 19.

The base 19 may be a unitary body or be configured to have a first base 19*a* and a second base 19*b* detachably combined to the first base 19*a*, as shown in the figures.

According to the present invention, there may be provided a means for guiding a target to a circular or rectangular direction so as to substantially punch patterns in the target in a circular or rectangular shape. Such guide means includes a standard marking 20 printed or marked on the surface of the base 19 and a guide protrusion 21, which is preferably formed in an arc shape on the base 19.

Figure 4:
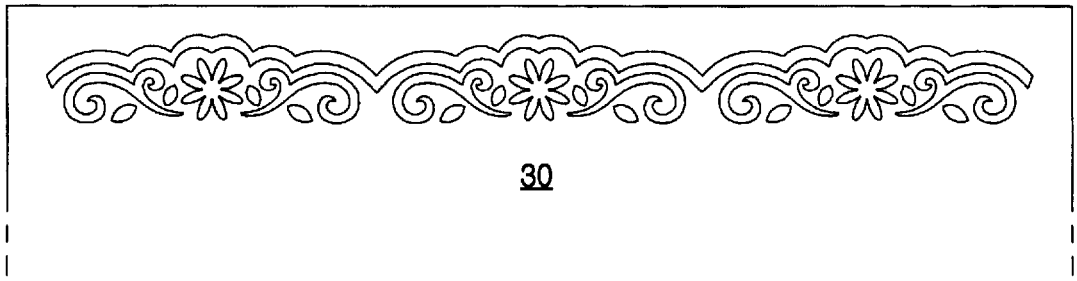
FIG. 4 shows a target that is punched in a straight line by the punching device of the present invention.

The standard marking 20 has a pattern corresponding to all or part of the section shape of the punch pin 13*a*. This standard marking 20 helps to move a target to a desired distance or angle so that a user may accurately and conveniently punch successive patterns in the target with moving or rotating the target. The shape of the standard marking 20 determines arrangement of successive patterns: whether to adjust the target to a straight direction or a circumferential direction, or whether to adjust the target to a circumferential direction of a small or big radius. For example, in case of punching successive patterns in a target with a standard marking 20, which is in parallel to the perforated pattern, the punched patterns become straightly arranged as shown in FIG. 4.

Figure 5:
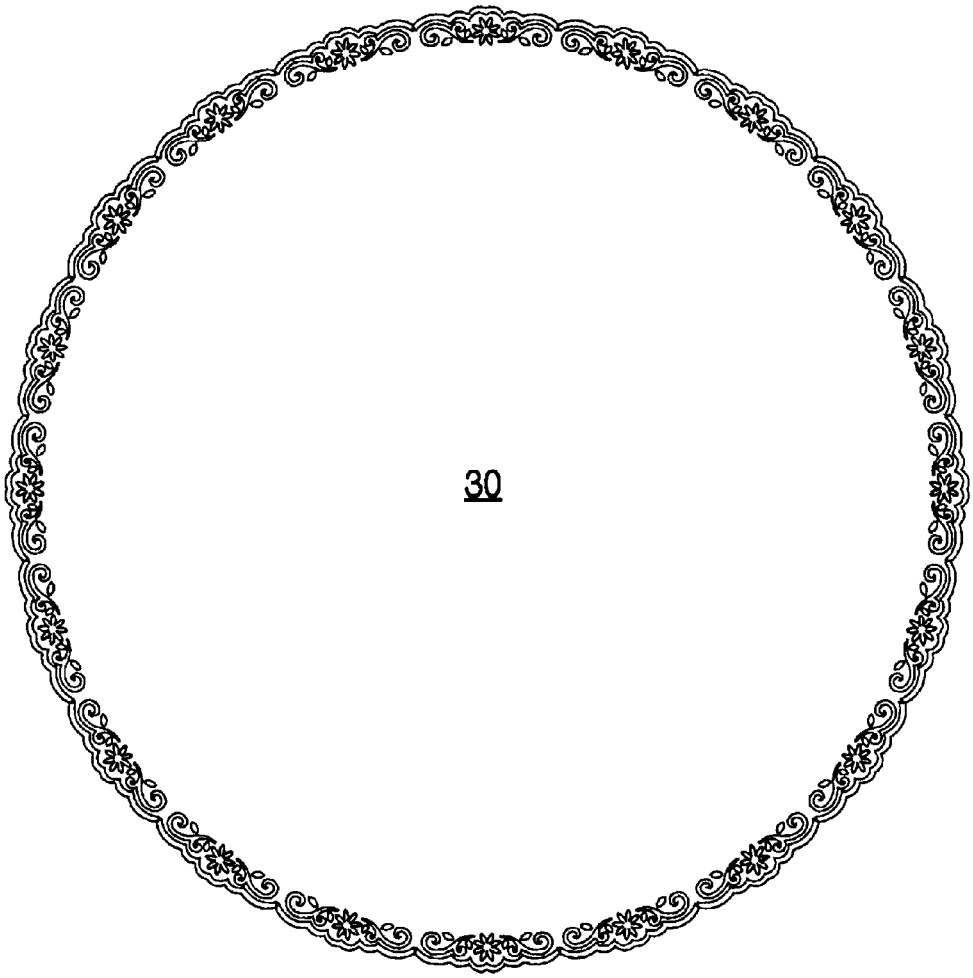
FIG. 5 shows a target that is punched in a garden type by the punching device of the present invention.
Figure 6:
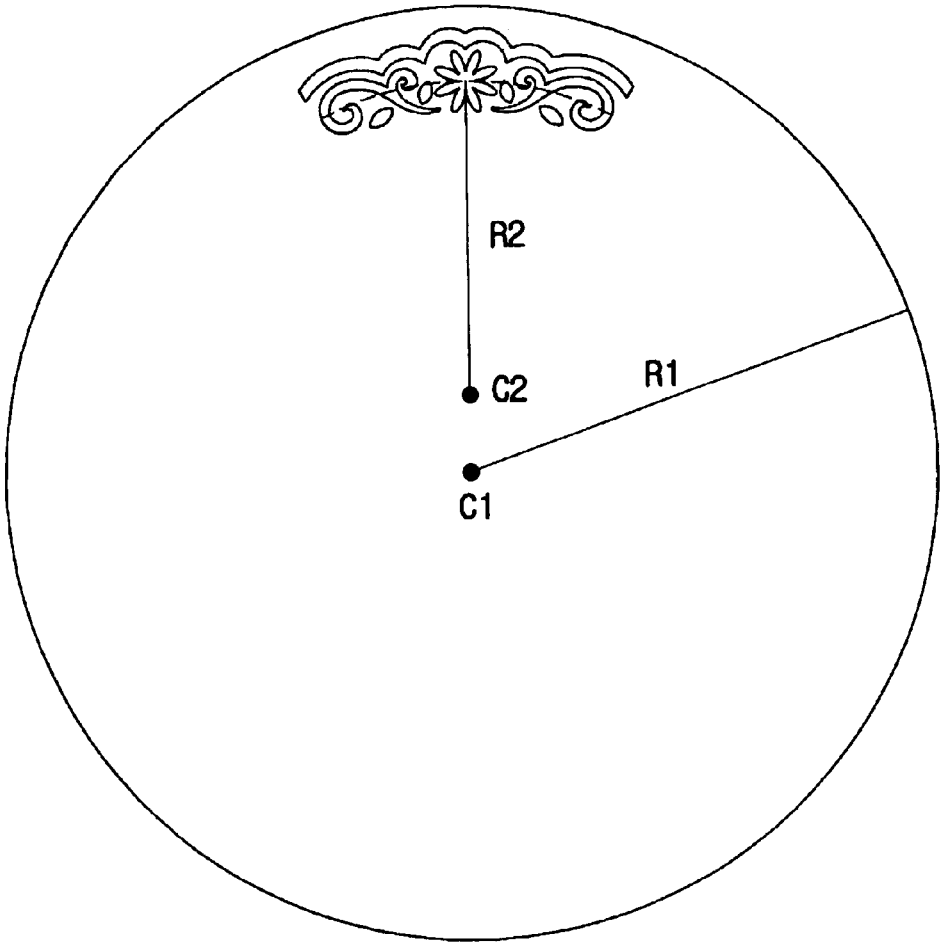
FIG. 6 is a diagram showing the radius of curvature of a circular target and the radius of curvature of a punching pattern.
Figure 16:
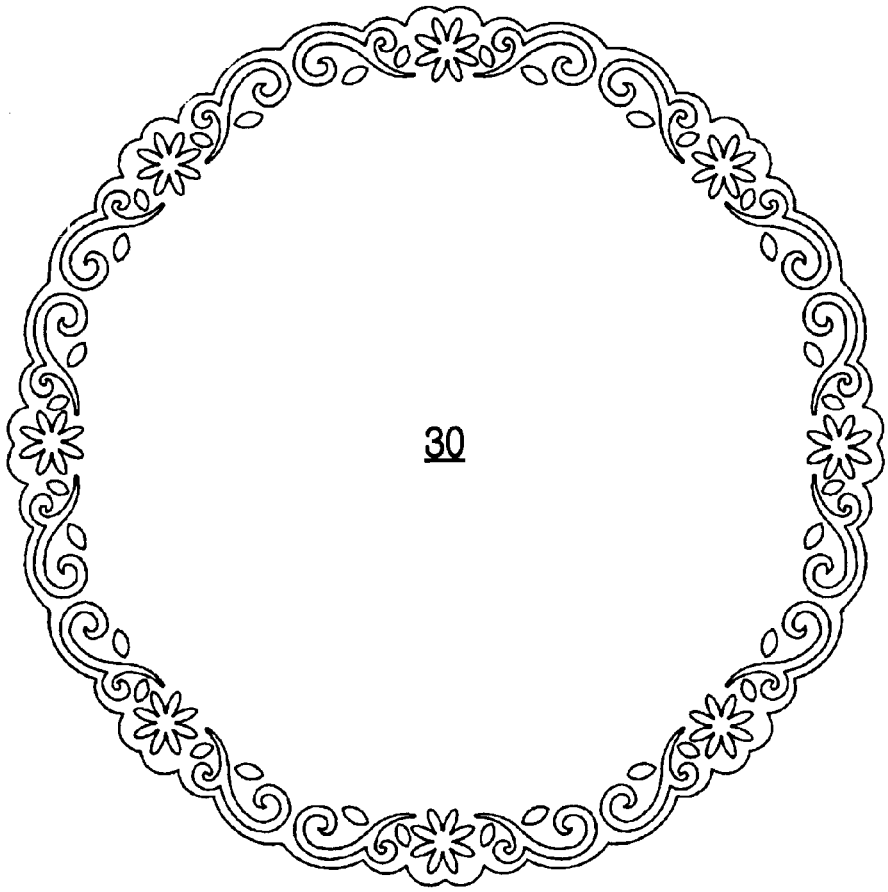
FIG. 16 shows the circular target, which is punched repeatedly in the same manner as FIG. 15.

On the other hand, in case of punching successive patterns in a target with a standard marking 20, which is inclined to the perforated pattern, the target would obtain punched patterns in circular or polygonal arrangement, as shown in FIGS. 5 and 16. In this case, a circular target 30 is preferably used, as shown in FIG. 6.

At this time, if a center C1 of the target 30 with the radius of curvature R1 is coinciding with a center C2 of the punched patterns with the radius of curvature R2, the punched patterns would be arranged in an accurate circle, as shown in FIG. 5.

On the other hand, of the center C1 of the target 30 is not coinciding with the center C2 of the punched patterns, the patterns would be punched in so-called flower arrangement due to an angle between each pattern in an arc.

Figure 7:
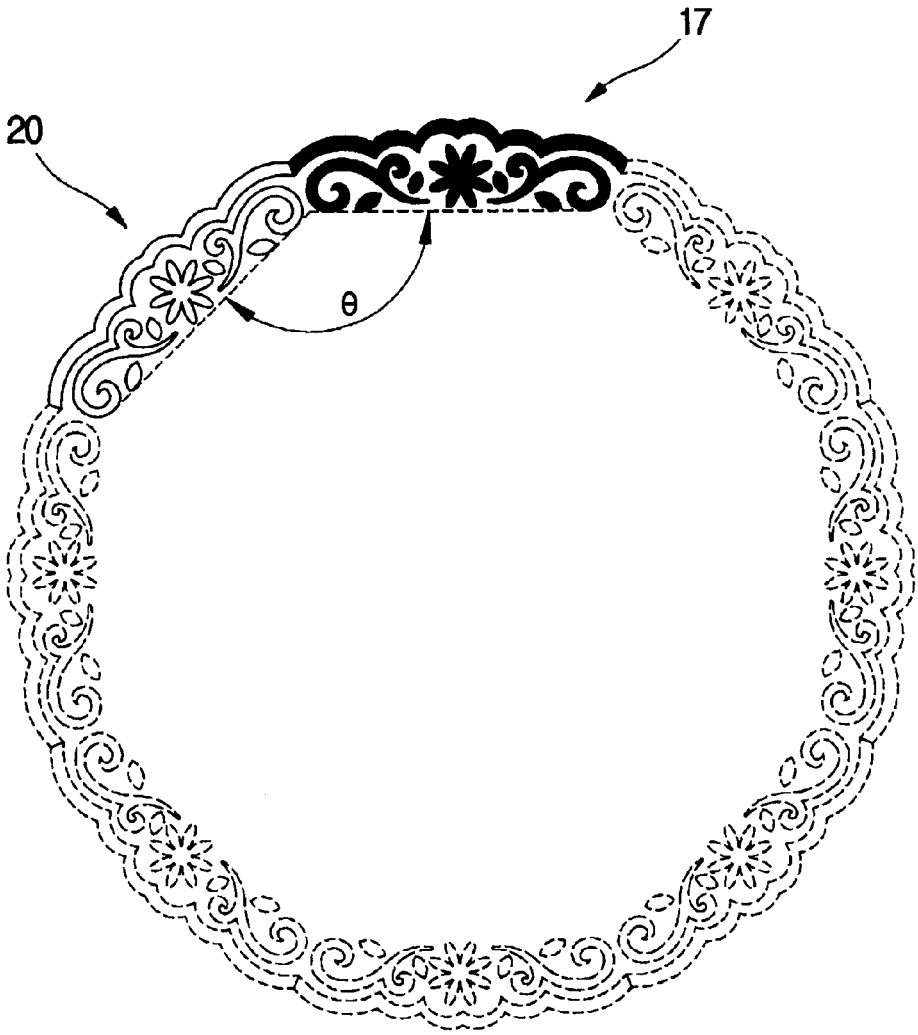
FIG. 7 schematically shows a standard marking formed at an angle with a perforated pattern according to the present invention.
Figure 8:
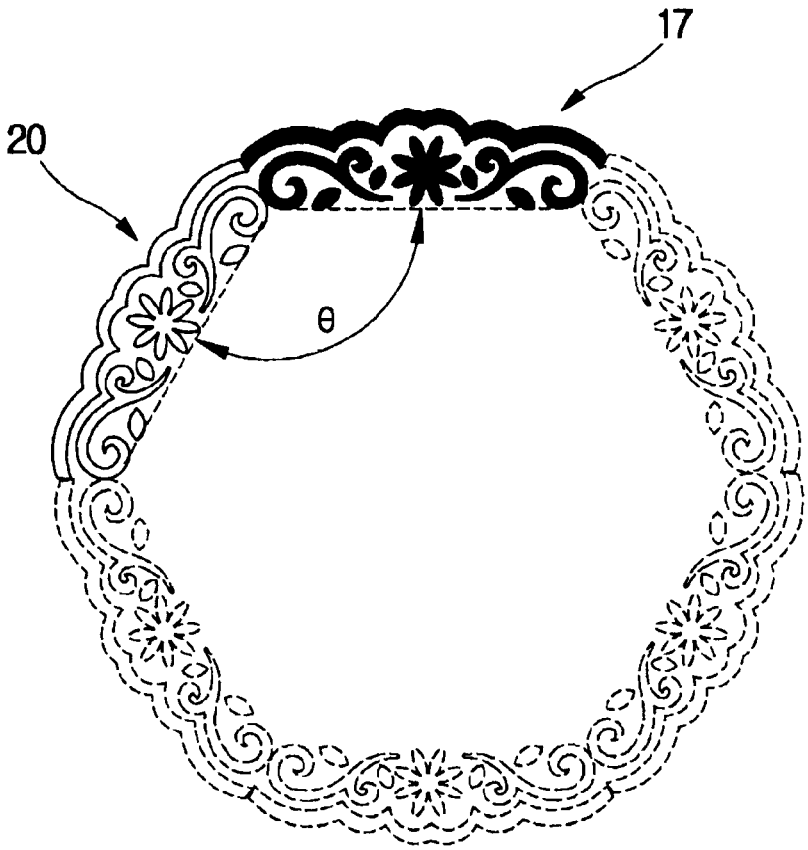
FIG. 8 schematically shows a standard marking formed at a smaller angle with the perforated pattern than the case of FIG. 7.
Figure 9:
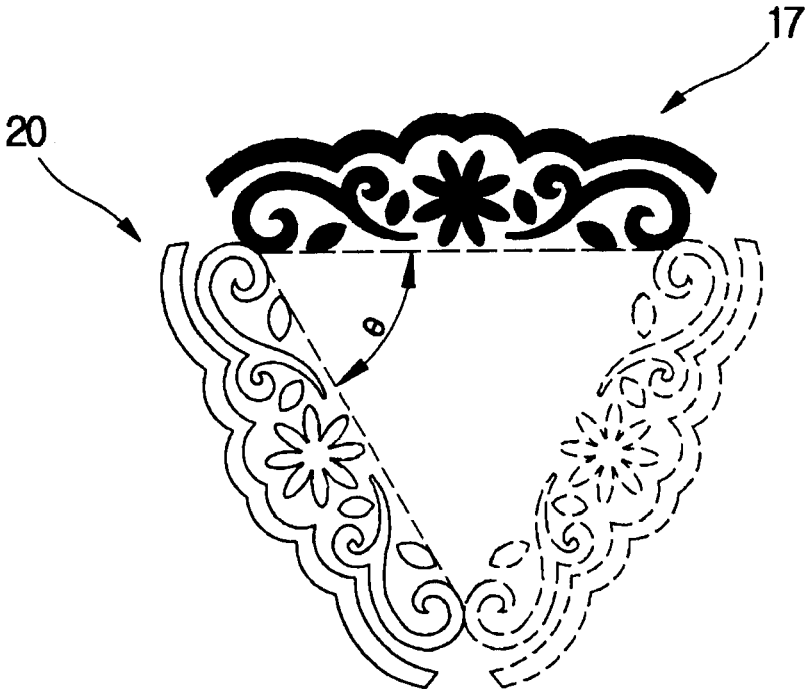
FIG. 9 schematically shows a standard marking formed at an angle of 60° with the perforated pattern.

If the pattern has a straight shape, not an arc shape, there is created an angle θ between the standard marking 20 and the perforated pattern 17. Thus, if punching the straight pattern successively in a target, the punched patterns would be arranged in an equilateral polygon, which has an interior angle θ. If the standard marking 20 were formed to have the angle θ decreased, the number of sides of the polygon would be reduced, like FIG. 8. At this time, a minimum value of the angle θ is 60°, which makes the punched patterns in a regular triangle, as shown in FIG. 9. In FIGS. 7 to 9, dotted patterns schematically show patterns, which would be obtained when punching the pattern after turning the target in a circumferential direction.

Figure 10A:
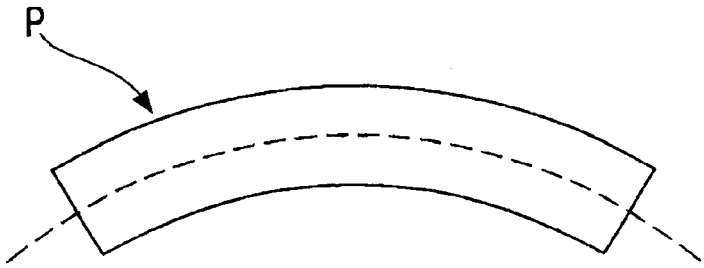
FIG. 10*a* is a schematic diagram showing a centerline of an arc pattern.
Figure 10B:
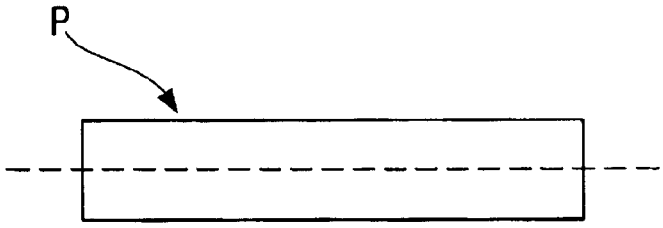
FIG. 10*b* is a schematic diagram showing a centerline of a straight pattern.

In this embodiment, the angle θ is defined as an angle between virtual lines of patterns, which respectively represent formation of the patterns. In FIGS. 7 to 9, a lower side of the pattern is set as the virtual line. But, not limited to that case, the virtual line can be set as a centerline of the pattern (P) as shown with dotted lines in FIGS. 10*a* and 10*b*. In addition, the virtual line can be a straight line or an arc depending on the pattern (P).

Figure 11:
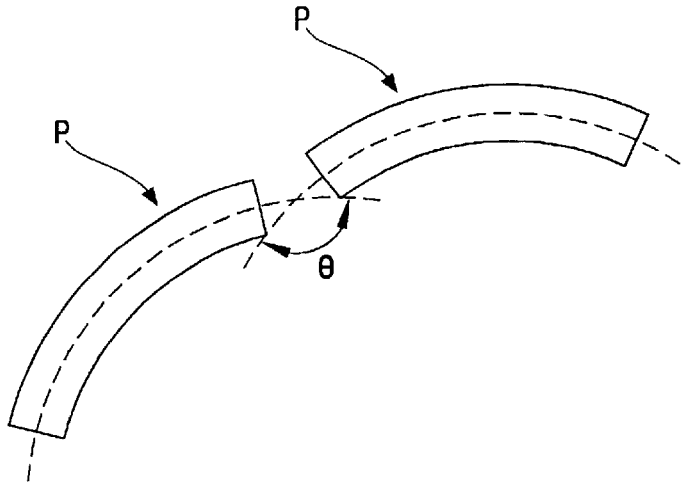
FIG. 11 exemplarily shows an angle between centerlines of two art patterns.

FIG. 11 schematically shows that arc virtual lines of two patterns are crossed at the angle θ. At this time, a maximum value of the angle θ is 180° when centers C1, C2 of the arc-type patterns are coincided as shown in FIG. 6, while a minimum value of the angle θ is 60° as described above.

As would be understood in the above description, the standard marking 20 is a basis of determining the angle θ between a punched pattern and a pattern to be successively punched in the target. Thus, the punching device of the present invention may obtain pattern arrangement in a target from a rectangular to a circle and the angle θ varies in a range of $60° \leqq \theta \leqq 180°$.

In this document, inventors define all figures such as circle, equilateral polygon and flower shape as 'closed polygon'. Though not scientific or lexicological, this term should be interpreted as defined above, not to be considered as indefinite, because it is defined as the inventors intended, on grounds of the principle that an inventor may define terms appropriately to express the best mode of his/her own invention.

In the present invention, it should be noted that the angle θ between patterns is preferably defined discontinuously. In other words, the angle θ should be preferably determined on consideration of the length of the pattern. More specifically, the angle θ is defined so that the integer-number of punched patterns should form an accurate closed polygon.

For example, in case of an equilateral polygon, the angle θ is determined with the following equation:

$$\theta = 180 - \frac{360}{n} \qquad \text{equation (1)}$$

where, n is the number of punched patterns.

As described above, since a size of the closed polygon can be adjusted depending on a position of the standard marking 20, it is preferred to form a plurality of standard markings at different angles to the perforated pattern 17 on the base 19 so that a user may select a size of the closed polygon with the standard markings.

Figure 12:
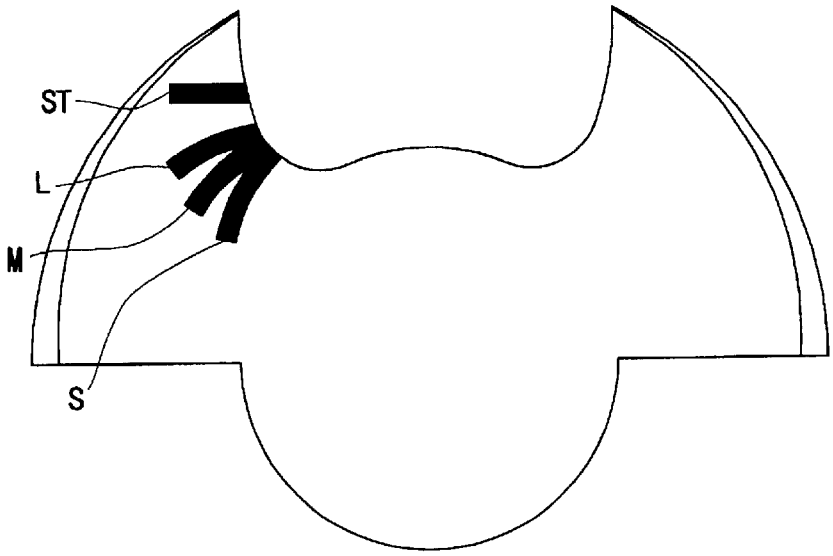
FIG. 12 is a schematic diagram showing that there are formed a plurality of standard markings at different angles to a perforated pattern.

The standard markings described as above are schematically shown in FIG. 12 as a dark pattern. Referring to FIG. 12, a standard marking ST is used to punch patterns in a straight line, while standard markings L, M and S are respectively used to punch patterns into a large, medium or small size.

Figure 13:
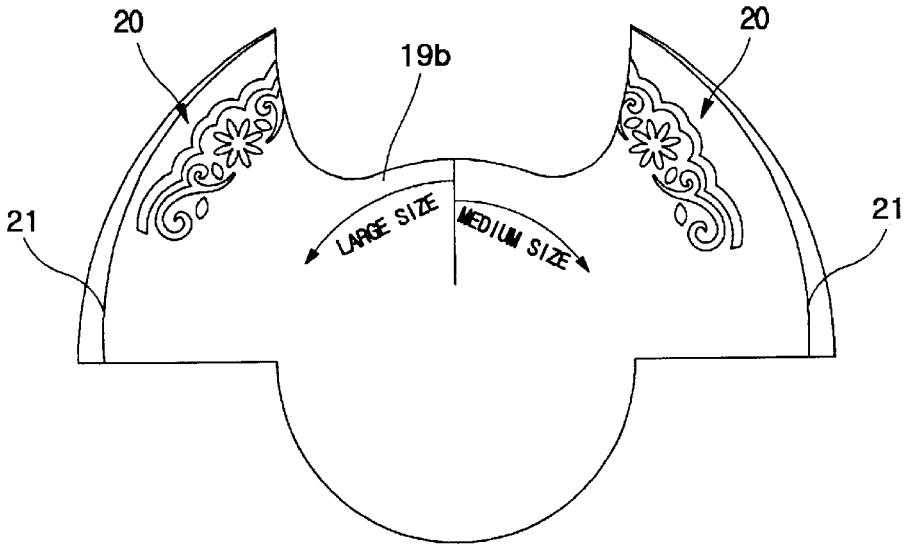
FIG. 13 is a schematic diagram showing that there are formed two standard markings at different angles to a perforated pattern.

FIG. 13 shows another example providing several standard markings. In FIG. 13, two standard markings at different angles to the perforated pattern 17 are respectively formed at both sides on the second base 19*b*. In this case, the patterns are punched in a relatively small size with turning a target clockwise, rather than the opposite case.

Preferably, the guide protrusion 21 is additionally formed on the second base 19*b* in an arc shape so that an outer circumference of a circular target may be fit thereto.

Now, a method of using the punching device of the present invention is described.

Figure 14:
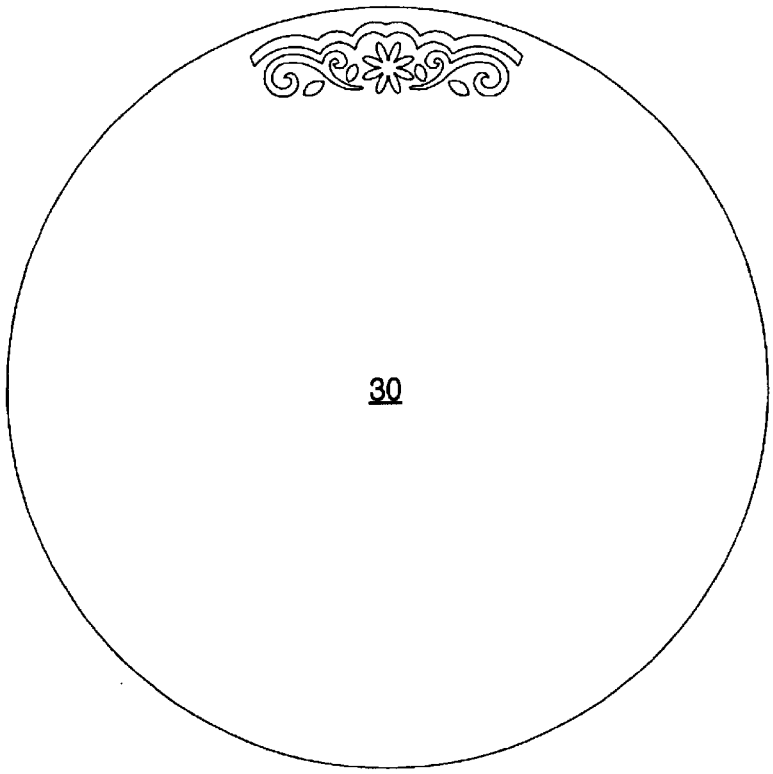
FIG. 14 shows a circular target, which is punched one time by the punching device of the present invention.

First, a target 30 with preferably a circular shape is inserted between the upper and lower plates 15*a*, 15*b* of the jig 15. If a user pushes down the pressing lever 10, a pattern is punched in the target 30 as shown in FIG. 14.

Figure 15:
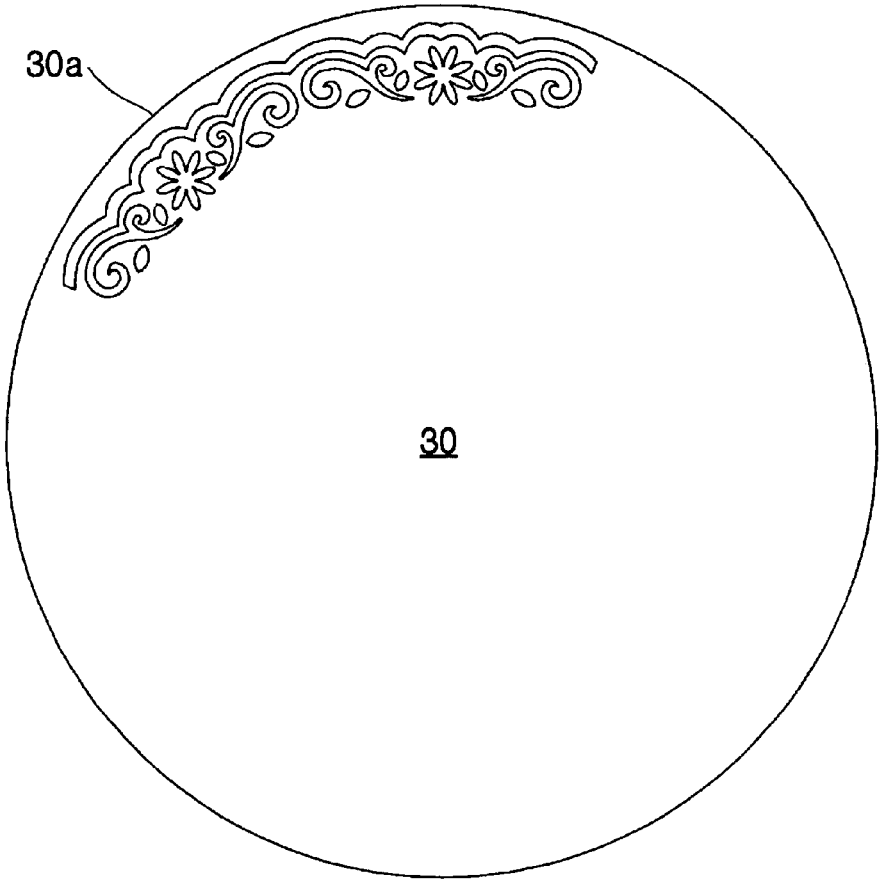
FIG. 15 shows the circular target of FIG. 14, which is punched once more conforming to the previously punched area.

Then, the target 30 is turned so that the punched pattern coincides with the standard marking 20. If a user pushes down the pressing lever 10 again in this state, another pattern is punched in the target 30 nearby the previously punched pattern, as shown in FIG. 15. At this time, since the rim cutting pin 13*b* is preferably configured in the punching member 13, a margin 30*a* is separated from the punched pattern.

By punching the pattern repeatedly as described above, the margin 30*a* are fallen apart and the closed polygon shown in FIG. 16 is obtained.

Figure 17:
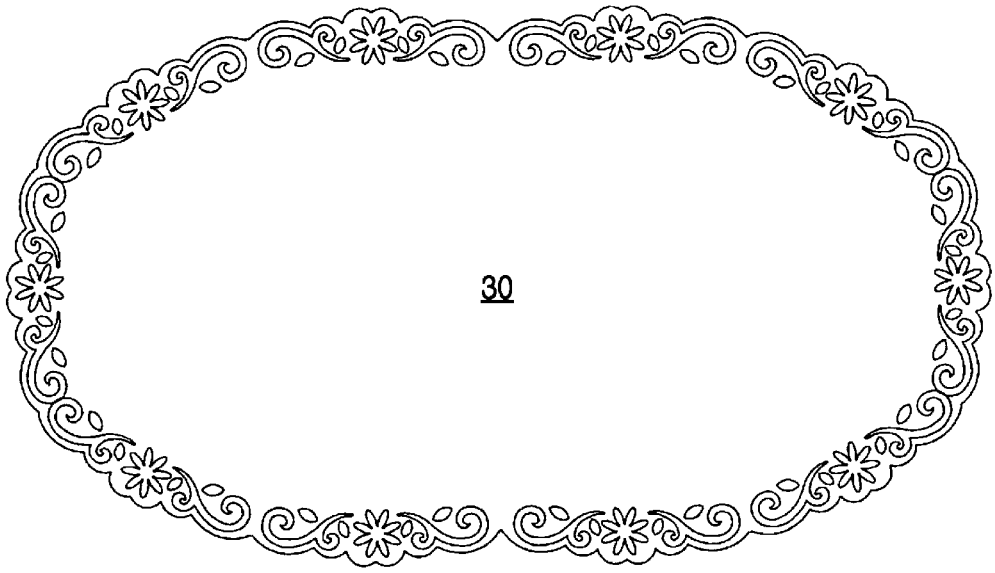
FIG. 17 shows a punched state in an oval shape by using the punching device of the present invention.

As an alternative, it is also possible to punch patterns in an oval-like shape as shown in FIG. 17 by using an arc standard marking and a straight standard marking together.

Figure 18:
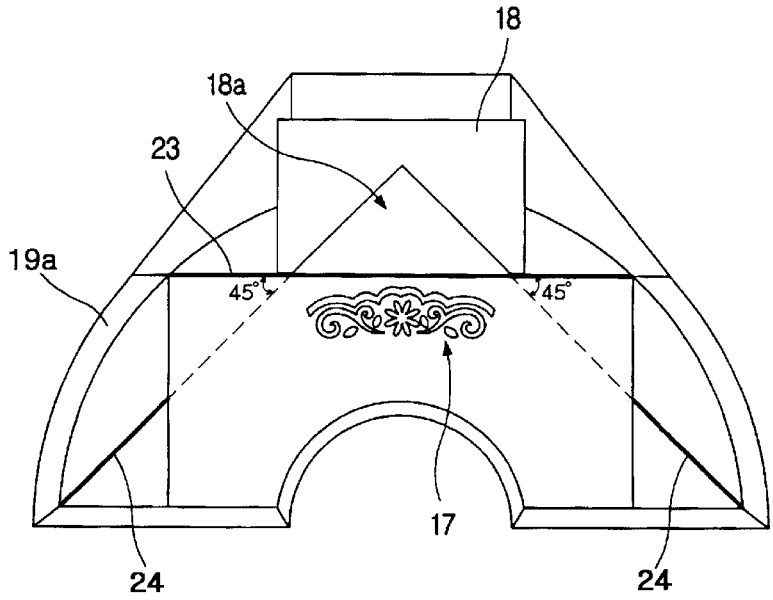
FIG. 18 shows a horizontal guide and an inclined guide formed on a base of the punching device according to another embodiment of the present invention.

According to another embodiment of the present invention, there is provided a punching device, which includes a horizontal guide 23 and an inclined guide 24 on the first base 19*a*, as shown in FIG. 18. This punching device enables to punch patterns in a rectangular target.

In more detail, the horizontal guide 23 is formed at the rear of the perforated pattern 17 so that a side of the rectangular target may be fit thereto, while the inclined guide 24 is formed at an angle of 45° to the horizontal guide 23 so that the side of the rectangular target is fit thereto after being turned 45° clockwise or counterclockwise.

The horizontal guide 23 and the inclined guide 24 may be formed by printing a line or providing a protrusion or a groove along the line on the first base 19*a*.

Additionally, a guide member 18 may be preferably provided at the rear of the perforated pattern 17 so as to restrict an insertion depth of a rectangular target, which inserted between the upper and lower plates 15*a*, 15*b* of the jig 15.

At this time, the guide member 18 preferably has a rectangular groove 18*a* with two members at a right angle so as to support the rectangular target, which is inserted between the upper and lower plates 15*a*, 15*b* with being fit to the inclined guide 24. In this case, a rectangular corner of the target inserted between the upper and lower plates 15*a*, 15*b* is supported by the rectangular groove 18*a* of the guide member 18.

Figure 19:
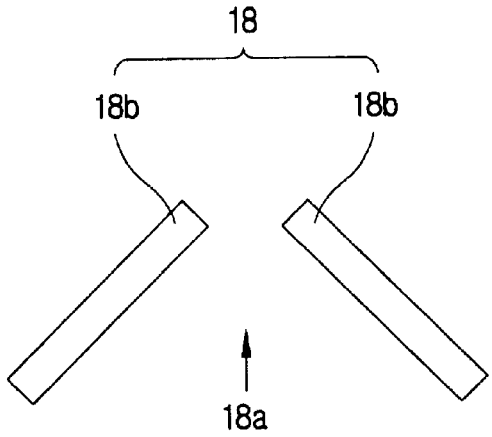
FIG. 19 is a schematic diagram showing an example of a guide member according to the present invention.
Figure 20:
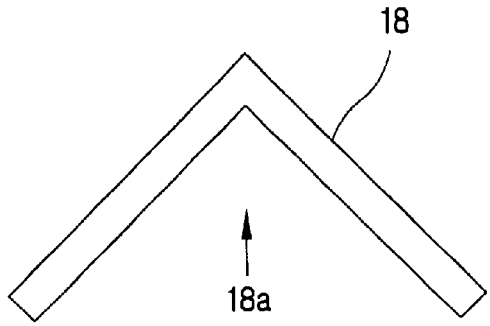
FIG. 20 is a schematic diagram showing another example of the guide member according to the present invention.

The guide member 18 can be a unitary body or have two guide bars 18*b* positioned at a right angle to form the rectangular groove 18*a* as shown in FIG. 19. Or else, two guide bars 18*b* can be linked each other to form the rectangular groove 18*a* as shown in FIG. 20.

Now, a method of using the punching device according this embodiment is described.

Figure 21:
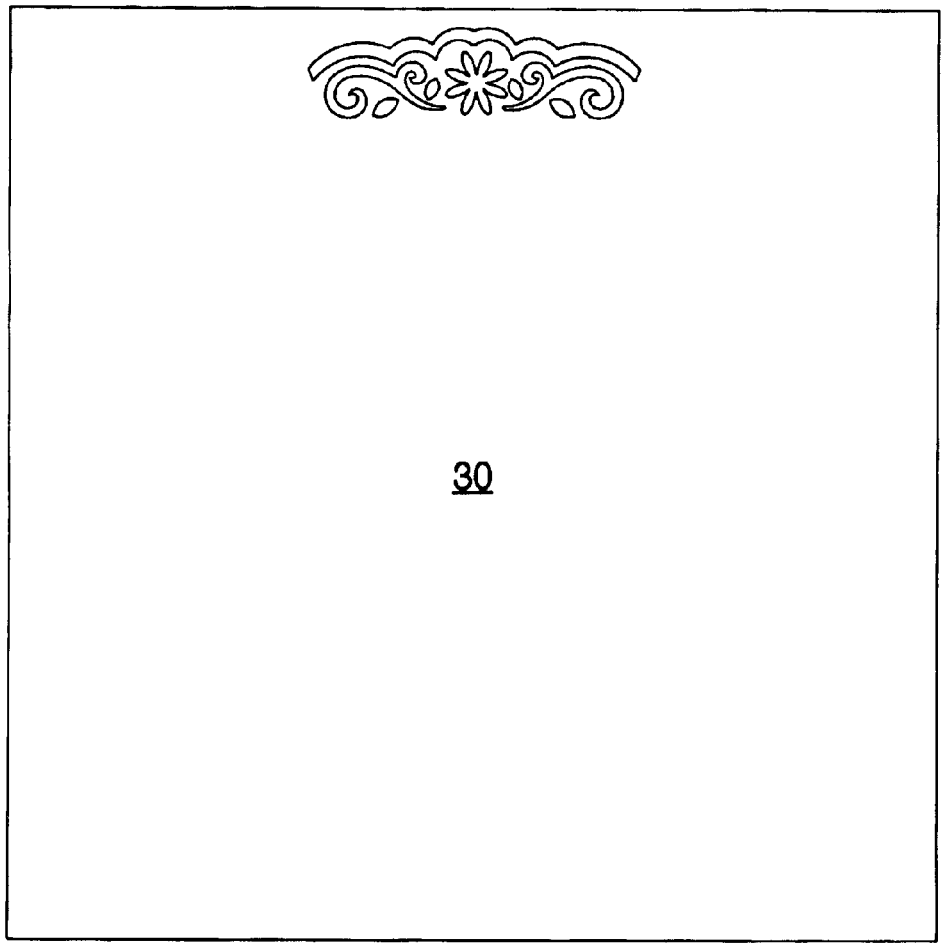
FIG. 21 shows a rectangular target, which is punched with a side of the target being fit with the horizontal guide.

First, a target 30 with preferably a rectangular shape is inserted between the upper and lower plates 15*a*, 15*b* of the jig 15. If a user pushes down the pressing lever 10, a pattern is punched in the target 30 as shown in FIG. 21.

Figure 22:
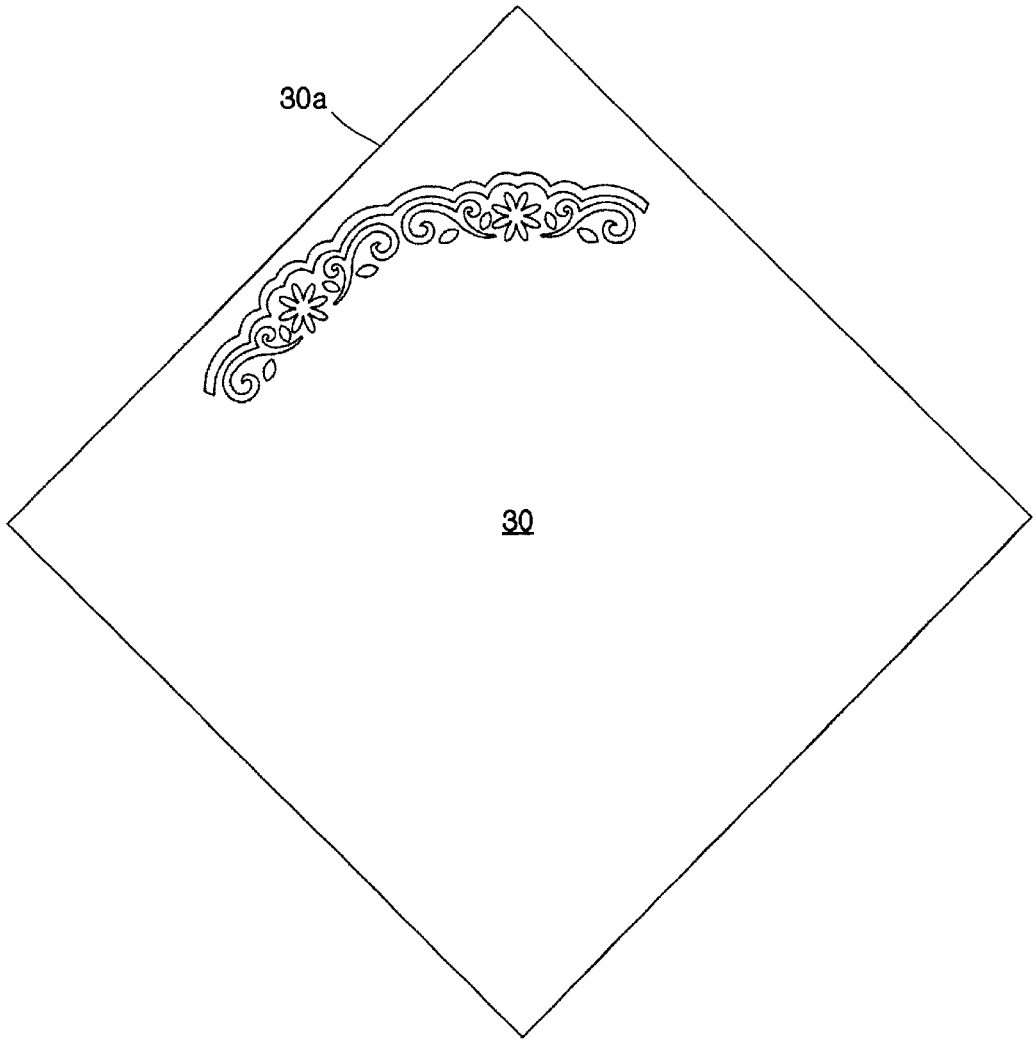
FIG. 22 shows the rectangular target of FIG. 21, which is punched once more after the target is turned 450 to be fit with the inclined guide.

After turning the target 30 at 45° counterclockwise, a user inserts the target 30 between the upper and lower plates 15*a*, 15*b* of the jig 15 so that a rectangular corner of the target 30 may be supported by the rectangular groove 18*a*. Then, if the user fits a side of the target 30 to the inclined guide 24 and then pushes down the pressing lever 10, a pattern is additionally punched in the rectangular target 30 as shown in FIG. 22.

By punching the pattern repeatedly as described above, the margin 30*a* are fallen apart from the target 30 and the closed polygon shown in FIG. 16 is obtained.

As described above, the punching device of the present invention enables to obtain various pattern arrangements such as circle, equilateral polygon or flower shape by punching a specific pattern successively in a target.

Therefore, the present invention gives an effect of punching an exquisite pattern along an edge of an object such as card, letter paper, photograph or other boards, which need edge decoration.

The present invention has been described in detail. However, it should be understood that the detailed description and specific examples, while indicating preferred embodiments of the invention, are given by way of illustration only, since various changes and modifications within the spirit and scope of the invention will become apparent to those skilled in the art from this detailed description.

What is claimed is:

1. A punching device for edge decoration comprising:

a jig in which a predetermined pattern is perforated, said jig configured to receive a target to be punched;

a punching member having a section corresponding to the perforated pattern, the punching member being slidable through the perforated pattern to punch the target; and a base combined with the jig and having a standard marking with a pattern corresponding to all or part of the perforated pattern, wherein the standard marking is formed so that a punched pattern of the target coincides with the standard marking by turning the punched target at a predetermined angle, which results in a closed polygon having a circumference corresponding to integer times of a length of the perforated pattern.

2. A punching device according to claim 1, wherein the jig includes:

an upper plate having a guide hole to guide sliding movement of the punching member; and a lower plate installed to the upper plate with a predetermined gap for insertion of a target for punching, wherein the pattern is perforated into the lower plate at a position corresponding to the guide hole.

3. A punching device according to claim 1, wherein the jig includes:

an upper plate having a guide hole to guide sliding movement of the punching member; and a lower plate installed to the upper plate with a predetermined gap for insertion of a target for punching, wherein the pattern is perforated into the lower plate at a position corresponding to the guide hole.

4. A punching device according to claim 1, wherein the base further has a guide protrusion to guide an outer circumference of a circular target for punching.

5. A punching device according to claim 1, wherein the base further has a guide protrusion to guide an outer circumference of a circular target for punching.

6. A punching device according to claim 1, wherein an additional standard marking is formed on the base at one or both sides of the perforated pattern in parallel to the pattern, and the additional standard marking has a pattern corresponding to all or part of the perforated pattern.

7. A punching device for punching an edge of a rectangular target into a closed polygon shape, comprising:

a jig in which a predetermined pattern is perforated and to which a target to be punched is supplied;

a punching member having a section corresponding to the perforated pattern, the punching member being slidable through the perforated pattern to punch the target;

a base combined with the jig, the base having a horizontal guide for aligning a side of the target thereto and an inclined guide having an angle of 45° with the horizontal guide so that the target is aligned thereto when turned 45°; and a guide member having two sides at a right angle to restrict insertion of the target to a predetermined level.

8. A punching device according to claim 7, wherein an additional standard marking is formed on the base at one or both sides of the perforated pattern in parallel to the pattern, and the additional standard marking has a pattern corresponding to all or part of the perforated pattern.

* * * * *